US008212643B1

(12) United States Patent
Folker et al.

(10) Patent No.: US 8,212,643 B1
(45) Date of Patent: Jul. 3, 2012

(54) BOBBIN FOR AN INDUCTIVE ELECTRONIC COMPONENT

(75) Inventors: Donald Folker, Madison, AL (US); Mike LeBlanc, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 12/428,120

(22) Filed: Apr. 22, 2009

Related U.S. Application Data

(60) Provisional application No. 61/079,217, filed on Jul. 9, 2008.

(51) Int. Cl.
*H01F 27/30* (2006.01)
*H01F 27/28* (2006.01)

(52) U.S. Cl. ..... 336/198; 336/195; 336/196; 336/197

(58) Field of Classification Search ..... 336/136, 336/182, 195, 196, 198, 222
See application file for complete search history.

(56) References Cited

U.S. PATENT DOCUMENTS

| | | | | |
|---|---|---|---|---|
| 863,175 | A | 8/1907 | Heinze, Jr. | |
| 3,661,342 | A * | 5/1972 | Sears | 242/118.41 |
| 4,151,500 | A | 4/1979 | Malerba et al. | |
| 4,156,888 | A | 5/1979 | Takahashi | |
| 4,166,265 | A | 8/1979 | Reynolds et al. | |
| 4,363,014 | A | 12/1982 | Leach et al. | |
| 4,405,913 | A | 9/1983 | Finkbeiner | |
| 4,473,811 | A * | 9/1984 | Schauble | 336/171 |
| 4,716,394 | A | 12/1987 | Gordon | |
| 4,887,061 | A | 12/1989 | Matsumura | |
| 4,980,664 | A | 12/1990 | Harwood | |
| 5,008,643 | A * | 4/1991 | Heritier-Best | 336/96 |
| 5,281,942 | A | 1/1994 | Stokes | |
| 5,321,572 | A | 6/1994 | Shibui et al. | |
| 5,726,616 | A | 3/1998 | Bell | |
| 5,815,061 | A | 9/1998 | Ho | |
| 5,831,505 | A * | 11/1998 | Yamaguchi et al. | 336/83 |
| 5,850,335 | A | 12/1998 | Otake | |
| 6,150,914 | A | 11/2000 | Borho et al. | |
| 6,191,677 | B1 * | 2/2001 | Orben et al. | 336/198 |
| 6,344,787 | B1 | 2/2002 | McGrane et al. | |
| 6,480,085 | B2 | 11/2002 | Chiang et al. | |
| 6,518,870 | B2 | 2/2003 | Yeh et al. | |
| 6,734,777 | B2 * | 5/2004 | Yeh et al. | 336/208 |
| 6,937,129 | B2 * | 8/2005 | Hsueh et al. | 336/208 |
| 7,218,199 | B1 * | 5/2007 | Chang | 336/212 |
| 7,271,691 | B2 | 9/2007 | Gu et al. | |
| 7,633,367 | B2 * | 12/2009 | Chen et al. | 336/198 |
| 7,639,111 | B2 * | 12/2009 | Hsu et al. | 336/192 |

* cited by examiner

*Primary Examiner* — Anh Mai
*Assistant Examiner* — Ronald Hinson
(74) *Attorney, Agent, or Firm* — Waddey & Patterson, P.C.; Mark J. Patterson; Matthew C. Cox

(57) ABSTRACT

A bobbin is designed to reduce the voltage stress between the winding layers of the inner winding of an inductive electronic component. A partition transversely extends from the winding surface of the bobbin to divide the winding surface into separated winding surface sections. A partition defines a passage for winding the coil from one winding surface section to the other winding surface section. Passage openings are positioned on each winding surface section relative the winding surface so that a portion of the partition is always between the passage opening and the oppositely disposed winding surface section.

20 Claims, 5 Drawing Sheets

BOBBIN FOR AN INDUCTIVE ELECTRONIC COMPONENT

CROSS-REFERENCES TO RELATED APPLICATIONS

This application is a Non-Provisional Utility application which claims benefit of provisional U.S. patent application Ser. No. 61/079,217 filed Jul. 9, 2008, entitled "TAPELESS INNER WINDING BOBBIN WITH TAPE PLACEMENT TOLERANCE SHELF" which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to a bobbin for an inductive electronic component. More particularly, this invention relates to a bobbin that isolates the winding turns of an inductive electronic component on two separate sections of a winding member.

Referring to FIG. 1, a cross sectional view of an inductive electronic component 11 that utilizes a prior art bobbin 10 is shown. The bobbin 10 has a winding member 12 and an inner winding 14 that is wound about the winding axis 16 of the winding member 12. The inner winding 14 has winding layers 14A each stacked on top of one another. The problem with this design is the high level of voltage stress created between each layer 14A of the inner winding 14. To reduce the voltage stress between the layers 14A of the inner winding 14, layers of insulation 14B, such as insulation tape, are placed between each one of these layers 14A. Unfortunately, these layers of insulation 14B take up room on the bobbin 10 which reduces the number of layers 14A that can be placed on the inner winding 14. Also, each layer of insulation 14B must be accurately placed over each winding layer 14A, otherwise the layers 14A may contact each other which results in unwanted voltage stress.

If the inductive electronic component 11 is a transformer, the inductive electronic component 11 may also have an outer winding 20 that is wound co-centrically on top of the inner winding 14. Unfortunately, this outer winding 20 also creates a voltage stress with the layers 14A of the inner winding 14. Consequently, an insulation layer 20A of insulation tape must be placed between the inner winding 14 and the outer winding 20.

The prior art attempts to resolve voltage stress problems by placing the primary and secondary winding on separate horizontal sections of a bobbin or by applying each winding on a separate bobbin and attaching the bobbins to one another. However, because the primary and secondary windings are not wound co-centrically, there is poor coupling between the primary and secondary windings.

What is needed then is a bobbin that reduces voltage stress between winding layers of the inner winding while maintaining the inner and outer windings co-centric.

BRIEF SUMMARY OF THE INVENTION

The present invention is a bobbin for an inductive electronic component that reduces the voltage stress between the layers of an inner winding. The bobbin has a winding member that defines a winding surface for winding the coil of the inductive electronic component. An inner winding is wound about two separate regions of the bobbin's winding surface. The winding regions are electrically isolated from one another thereby reducing by one-half the voltage stress on the inner winding. This dramatic reduction in voltage stress means that insulation layers are not required between each layer of the inner winding.

A partition transversely extends from the winding surface and divides the winding surface into a first winding surface region and a second winding surface region. To maintain each section of the inner winding magnetically coupled yet electrically isolated, the partition defines a passage between the winding regions. A coil may be wound about the first winding surface region about the passage and around the second winding surface region to form the inner winding. To isolate the turns on the first winding surface region from the turns on the second winding surface region, the passage openings are positioned on the winding surface so that a portion of the partition separates the first passage opening from the second winding surface region and a portion of the partition separates the second passage opening from the first winding surface region.

In one embodiment, the partition has first and second partition walls formed between the first and second winding regions. The partition walls are separated by an axial distance to define the passage. The partition wall adjacent the first winding surface region has the first passage opening and the partition wall adjacent the second winding surface regions has the second passage opening. These passage openings are unaligned with respect to one another so that the partition is always between the first passage opening and the second winding surface region, and the second passage opening and the first winding surface region. In this arrangement, the sections of the coil on either side of the winding surface are electrically isolated from one another.

DETAILED DESCRIPTION OF THE INVENTION

Figure 1:
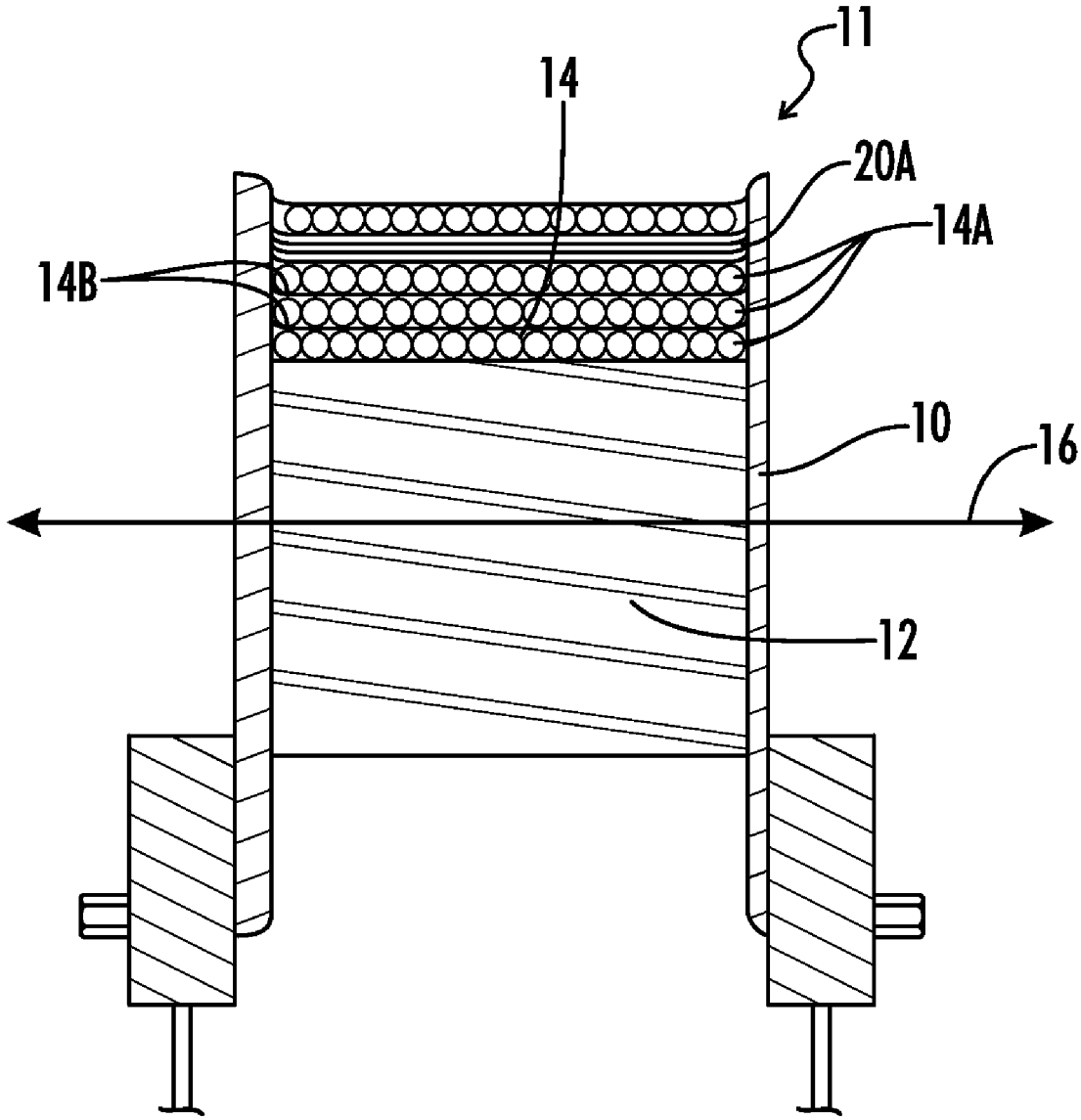
FIG. 1 (PRIOR ART)
FIG. 1 is a cross-sectional view along the winding axis of an inductive electronic component having inner and outer windings wound about a prior art bobbin.
Figure 2:
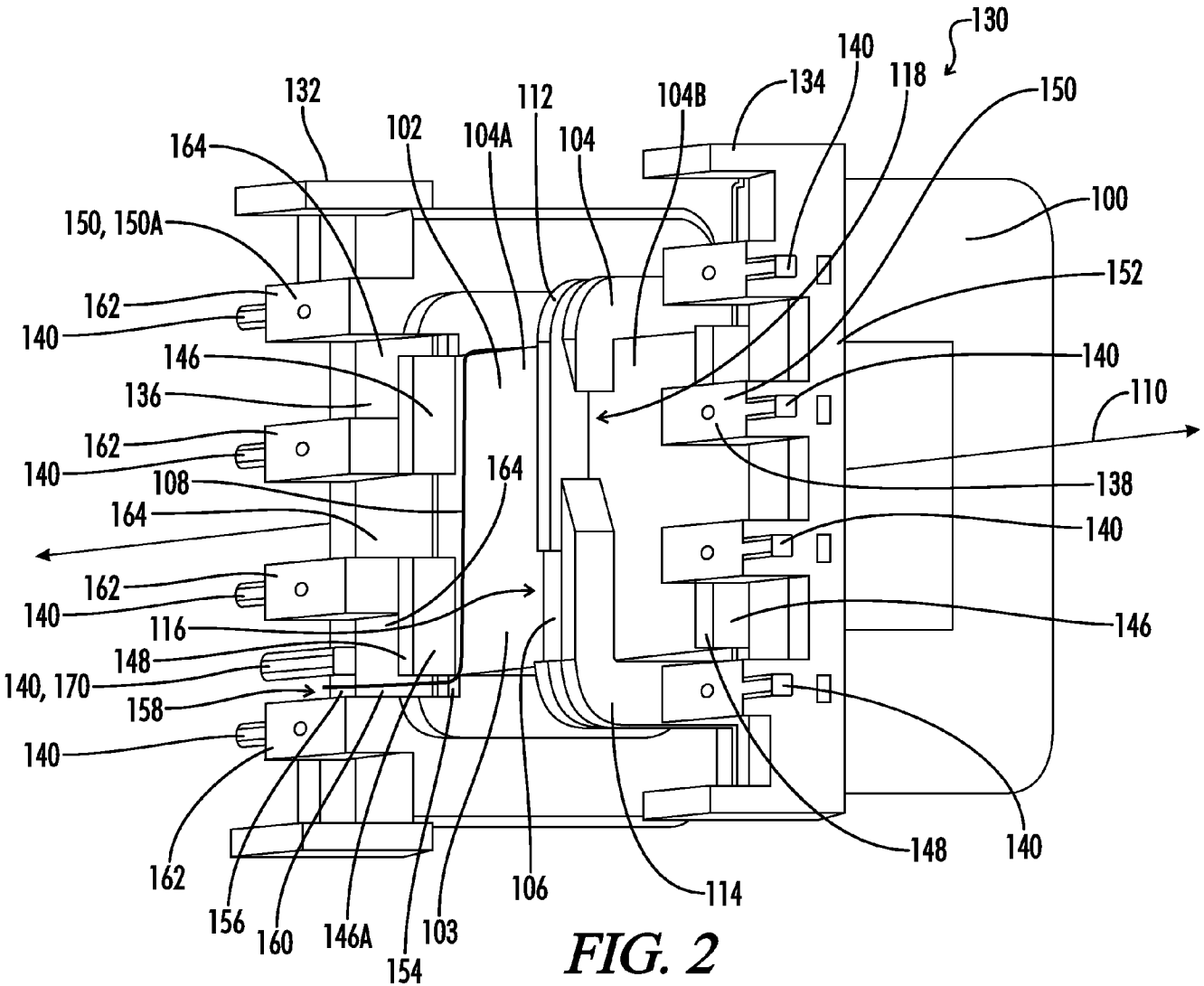
FIG. 2 is a perspective view of one embodiment of a bobbin in accordance with the invention.

FIG. 2 shows an embodiment of the bobbin 100 in accordance with the invention. The bobbin 100 has a winding member 102 with a winding surface 103 for winding a coil 108 around the winding axis 110. Winding member 102 should be magnetically conductive so that when a current is induced on the coil 108, a magnetic current can flow through the winding member 102. Winding member may be of any shape. In the illustrated embodiment, winding member 102 is shaped to have a rectangular cross-section. However, the winding member may have a circular cross-section, elliptical cross-section, octagonal cross-section or be of any other shape convenient to the particular application. A partition 104 transversely extends from the winding surface 103 to divide the winding surface 103 into a first winding surface region 104A and a second winding surface region 104B. Partition 104 defines a passage 106 so that the coil 108 may be wound around the first winding surface region 104A through the passage 106 and onto the second winding surface region 104B.

Figure 3:
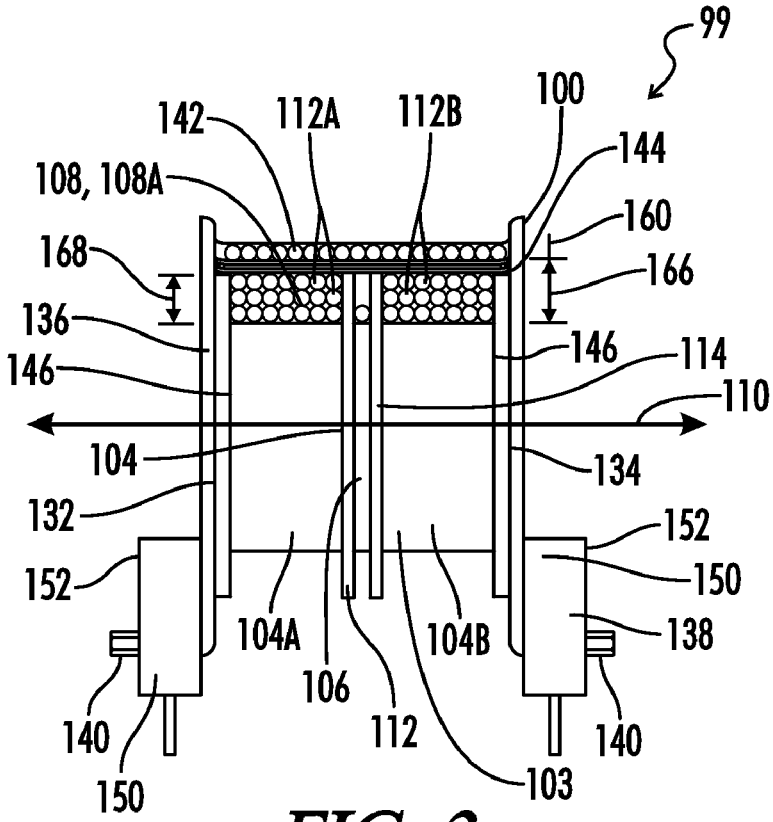
FIG. 3 is a cross-sectional view cut along the winding axis of an inductive electronic component that utilizes the bobbin shown in FIG. 2.

Referring now to FIG. 3, a cross-section of an inductive electronic component 99 that utilizes the bobbin 100 is shown cut along the winding axis 110. In the illustrated embodiment, the inductive electronic component 99 is a transformer. The coil 108 is wound around winding surface 103 to form the inner winding 108A of the transformer. The bobbin 100 divides the inner winding 108A into a first set of turns 112A around the first winding surface region 104A and a second set of turns 112B around the second winding surface region 104B. While the turns 112A and 112B of the inner winding 108A are electrically isolated from one another by partition 104, the turns 112A and 112B are connected to one another through the passage 106. To do this in a manner that minimizes heating losses, the coil 108 is wound about the first winding region 104A, around the passage 106 in the partition 104, and then onto the second winding surface region 104B.

Referring now to FIGS. 2 and 3, the partition 104 of the illustrated embodiment has a first partition wall 112 and a second partition wall 114. The partition walls 112, 114 are separated by an axial distance relative the winding axis 11 to form the passage 106. The first partition wall 112 has a first passage opening 116 so that the coil 108 can be wound from the first winding surface region 104A into the passage 106. The second partition wall 114 also has a second passage opening 118 so that the coil 108 may be wound from the passage 106 onto the second winding surface region 104B. In some embodiments, the passage 106, or middle cross over section, is axially aligned with an air gap, or core air gap 204, formed by a transformer core 202*a*, 202*b* when a transformer core is positioned in the bobbin. Thus, the passage 106, or middle cross over section, removes the winding from over the air gap 204 in the core 202*a*, 202*b*. Such axial alignment of the passage 106 with the core air gap 204 eliminates flux fringing heating and losses, thereby increasing efficiency.

Partition 104 isolates the first winding surface region 104A and the second winding surface region 104B to reduce the voltage stress on the coil 108 wound about the winding surface 103. To do this, the passage openings 116 and 118 are positioned relative to winding surface 103 so that the partition 104 separates the first passage opening 116 from the second winding surface 104B and the partition separates the second passage opening 118 from the first winding surface region 104A.

Figure 4:
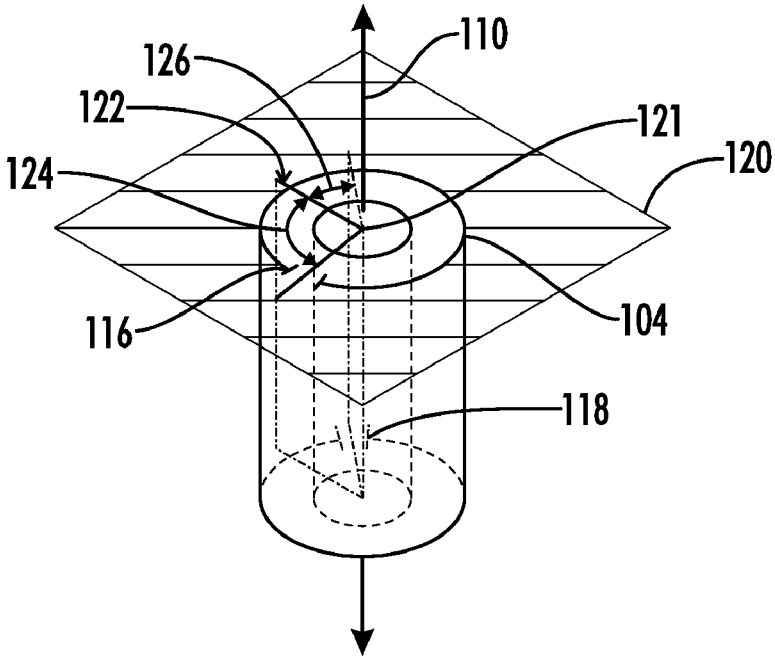
FIG. 4 illustrates the positions of passage openings in the bobbin shown in FIG. 2 relative the winding axis and a plane orthogonal to the winding axis.

As shown in FIG. 4, if one were to define a reference plane 120 orthogonal to the winding axis 110 and a reference axis 122 on that reference plane 120 having an origin 121 at the winding axis 110, the first passage opening 116 would be positioned to have a first angular position 124 on the reference plane 120 relative to the reference axis 122. In contrast, the second passage opening 118 would have a second angular position 126 on the referenced plane 120 relative the reference axis 122. Because the first and second angular positions 124 and 126 of the openings 116, 118 are different, the first passage opening 116 and the second passage opening 118 are not aligned relative to one another. Referring again to FIGS. 2 and 3, the opposite partition wall 114, 112 relative the partition wall 112, 114 that defines a respective opening 116, 118 separates the respective opening 116, 118 from the winding surface region 104B, 104A, respectively.

While the illustrated embodiment utilizes two partition walls 112 and 114 to isolate winding surface regions 104A, 104B, other configurations may be utilized for the partition 104. For example, the partition 104 may be a single partition wall (not shown) transversely extending from the winding surface 103. The single partition wall would form a spiral shape along the winding surface 103. to separate the partition openings, 116, 118. In fact, in this configuration, the partition openings may actually be aligned with one another since the spiraled portion of the spiral partition wall would be between the openings.

Referring again to FIGS. 2 and 4, in this manner the turns 112A and 112B, are coupled via passage 106 but are isolated relative to one another to reduce the voltage stress between the layers of the coil 108. It should be understood that while the reference plane 120 is orthogonal to the winding axis 110, this does not necessarily mean the partition 104 must be perpendicular to the winding axis 110. In other words, the partition 104 may be defined on the winding member 102 so that it is tilted upward or downward relative to winding axis 110. Even if the partition 104 is titled upward or downward, the passage openings 116 and 118 still have the relationship with the reference plane 120 because the projection of angular position 124, 126 of these passage openings 116, 118 onto the reference plane 120 is the same regardless of the manner in which the partition extends out of the winding surface 103.

Furthermore, it should be understood that "transversely extending" from the winding surface 103 is not limited to a perpendicular or orthogonal relationship with the winding surface 103 or the winding axis 110. To transversely extend may mean that if one were to draw a vector parallel to the winding axis 110 and a vector in the direction of extension from the winding surface 103, the sine of the angle between the vectors would be a non-zero quantity.

Figure 5:
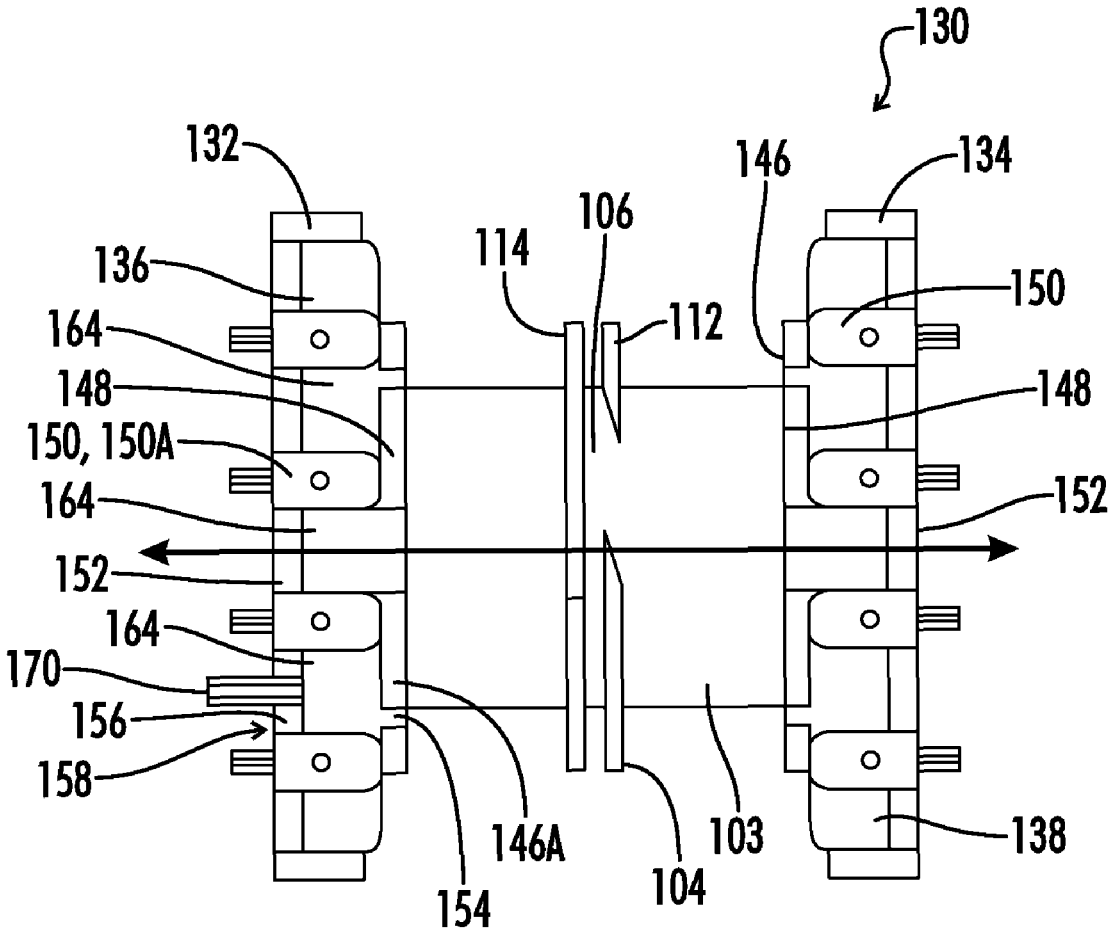
FIG. 5 is a bottom view of the bobbin shown in FIG. 2.
Figure 6:
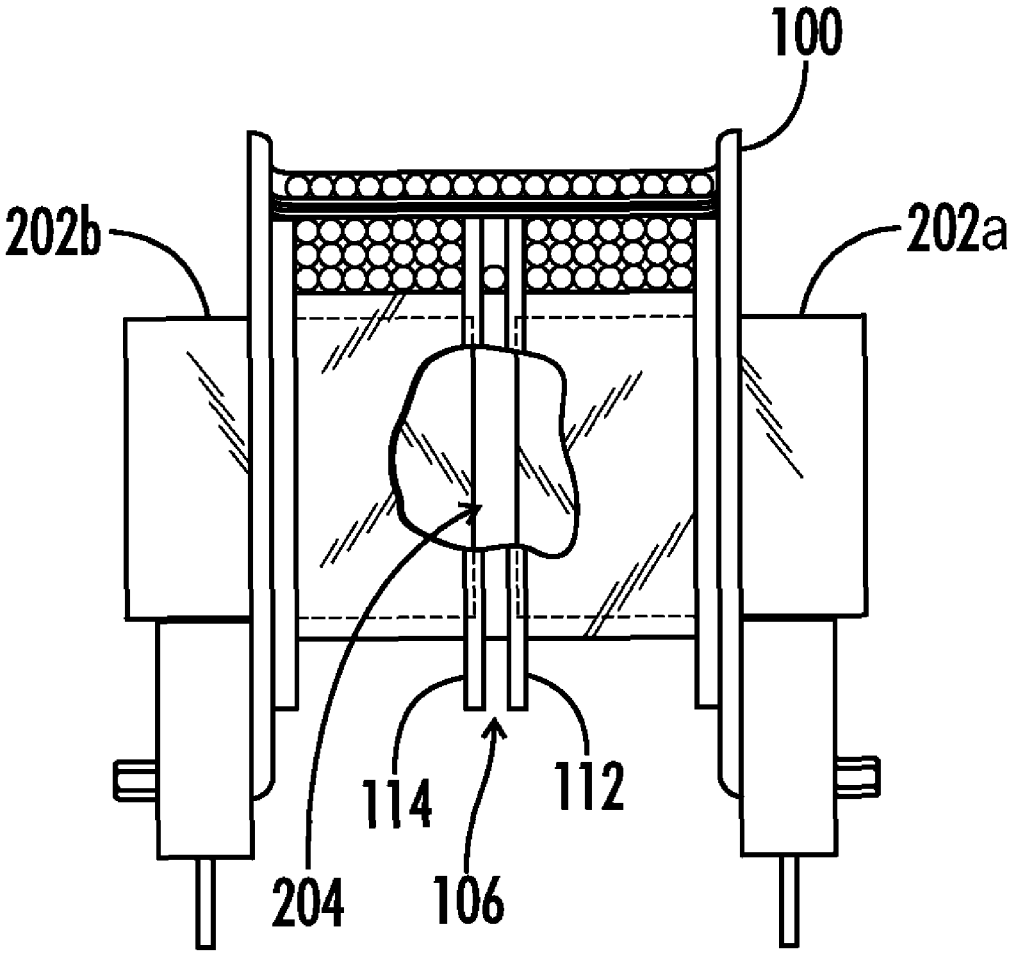
FIG. 6 is a partial cross-sectional view of an embodiment of a bobbin showing an air gap in the core aligned with a winding passage in accordance with the present invention.

Referring again to FIGS. 2, 3 and 5, the winding member 102 may be part of a magnetically conductive core 130 having a first and second end wall 132, 134 at the first and second ends 136, 138 of the winding member 102. First and second end walls 132 and 134 are transverse to winding surface 103 and the winding axis 110 and in this embodiment are perpendicular to the winding surface 103. These end walls 132, 134 generally have pins 140 for connecting wires to the inductive electronic component. In the illustrated embodiment, the bobbin 100 is being utilized to create a transformer. Coil 108 may be wound on top of the inner winding 108A to form an outer winding 142 of the transformer. This co-centric arrangement for creating the transformer is advantageous for magnetically coupling the inner windings 108A and outer winding 142. Such an arrangement maximizes the magnetic coupling between each of the windings 108A and 142A while at the same time reducing fringe flux. Because the turns of the inner winding 112A, 112B are divided over two separate regions 104A, 104B of the winding surface 103, the voltage stress between the layers of the inner winding 108A is reduced in half so that no insulating layers are required between the layers of inner winding 108A. This permits the inner winding 108A to be thicker. Accurate placement of the insulation layer 144 between each of these layers is no longer required. This maximizes the efficiency and reduces the manufacturing costs of the inductive electronic component 99.

Referring again to FIGS. 2, 3, and 5, the first and second end walls 132, 134 define a shoulder 146 having a shoulder surface 148 above the winding surface 103. This shoulder surface 148 determines the location of the insulation layer 144 between the inner winding 108A and the outer winding 142. After the coil 108 is wound about the winding surface 103, inner winding 108A should have a height 166 relative the winding surface 103 that is less than or equal to the height of the shoulder surfaces 148. The insulating layer 144 should be positioned at a height 168 equal or above the height of the shoulder surface 148. The coil 108 is wound on top of the insulation layer 144 to form the outer winding 142 of the transformer. The height 168 of the shoulder surfaces 148 thereby serves to indicate the maximum height 166 of the inner winding 108A and to position of the insulating layer 144.

The first and second end walls 132, 134 also have outer walls 150 with an exterior surface 152 oppositely disposed from the shoulder 146. To receive coil 108 onto the winding member 102, one of the shoulders 146A may form an entry slot 154 positioned to begin winding the coil 108 over the first winding surface region 104A. The bottom of this entry slot 154 may be positioned to be parallel with the winding surface 103 and directly adjacent to the winding member 102 so that the coil 108 is easily received for winding about the winding surface 103.

However, because the outer wall 150A may have a thickness, it may be difficult to determine the exact location of the entry slot 154 from the outer wall 150A. Outer wall 150A may thus define a guiding slot 156 that is aligned with the entry slot 154. The guiding slot 156 may define an open end 158 at the exterior surface 152 of the outer wall 150 for receiving the coil 108. Coil 108 is inserted through the open end 158 of the guiding slot 156 into the entry slot 154. This portion of the coil 108 in slots 156 and 154 may be defined as a starting portion 160 of the coil 108. Starting portion 160 may receive the current that is induced on the winding 108A and may be substantially perpendicular to the first set of turns 112A of the inner winding 108A.

To indicate the location of the open end 158 of the guiding slot 156, a guiding pin 170 may extend from the exterior surface 152 of outer wall 150A. In this manner, the location for inserting the coil 108 into the bobbin 100 is easily determined. In this embodiment, the outer wall 150A has portions 162 at a height greater than the shoulder surface 148 and portions 164 that are below the height of the shoulder surface 148 and parallel with the winding surface 103. In the illustrated embodiment, the guiding slot 156 is created by placing the guiding pin 170 on one of the lower portions 164 of the outer wall 150A. The guiding pin 170 is placed proximate one of the higher portions 162 of the outer wall 150A so that the gap between the guiding pin 170 and the higher portion 162 forms the guiding slot 156. This guiding pin 170 is positioned so that the guiding slot 156 is aligned with the entry slot 154 and the shoulder surface 148.

Thus, although there have been described particular embodiments of the present invention of a new and useful BOBBIN FOR AN INDUCTIVE ELECTRONIC COMPONENT, it is not intended that such references be construed as limitations upon the scope of this invention except as set forth in the following claims.

What is claimed is:

1. A bobbin for an inductive electronic component having a coil, the electronic component including a transformer core positioned in the bobbin, the transformer core forming an air gap, the bobbin comprising:

a magnetically conductive member that defines a winding surface for winding the coil; and a partition transversely extending from the winding surface, the partition separating the winding surface into a first winding surface region and a second winding surface region, the partition defining a passage for winding the coil from the first winding surface region to the second winding surface region and defining a first passage opening into the passage at the first winding region and a second passage opening into the passage at the second winding region, the passage openings being positioned relative the winding surface so that the partition separates the first passage opening from the second winding region and the partition separates the second passage opening from the first winding region, the passage being axially positioned over the air gap in the transformer core.

2. The bobbin of claim 1, wherein the partition further comprises a first partition wall adjacent to the first winding surface region and a second partition wall adjacent to the second winding surface region wherein the passage is defined between the partition walls.

3. The bobbin of claim 2 further comprising:

the magnetically conductive member defines a winding axis;

the winding surface of the magnetically conductive member is defined about this axis;

a reference plane orthogonal to the winding axis;

a reference axis on the plane having an origin at the winding axis;

the first opening being positioned on the first partition wall and having a first angular position on the reference plane relative the reference axis; and the second opening being positioned on the second partition wall and having a second angular position on the reference plane relative the reference axis different than the first angular position of the first opening.

4. The bobbin of claim 1 further comprising:

the magnetically conductive member having a first end and a second end;

a first end wall at the first end of the magnetically conductive member that is transverse to the winding surface;

a second end wall at the second end of the magnetically conductive member that is transverse to the winding surface; and each end wall having a shoulder that defines a shoulder surface above the winding surface.

5. The bobbin of claim 4, wherein the shoulder of the first end wall defines an entry slot positioned to insert the coil and begin winding the coil over the first winding surface region.

6. The bobbin of claim 5, wherein the first end wall further comprises an outer wall, the outer wall defining a guiding slot that is substantially aligned with the entry slot.

7. The bobbin of claim 6 further comprising:

the outer wall having an exterior surface oppositely disposed from the shoulder of the first end wall, the guiding slot having an opening at the exterior surface; and a guiding pin that extends out of the exterior surface of the outer wall, and is positioned to indicate the location of the open end of the guiding slot.

8. The bobbin of claim 7, wherein the guiding pin extends into the outer wall to form a side of the guiding slot.

9. An inductive electronic component for a core having a core air gap, the component comprising:

a bobbin having a winding surface that includes a first surface section and a second surface section;

a partition transversely extending from the winding surface between the first surface section and a second surface section, the partition defining a passage around the winding surface that leads from the first surface section to the second surface section and the passage having a first section passage opening at the first surface section and a second section passage opening at the second surface section;

a winding, the winding being wound around the first surface section of the winding surface through the passage and around the second section of the winding surface to define a first set of winding turns on the first surface section of the winding surface and a second set of winding turns on the second surface section of the winding surface;

wherein the passage openings are positioned relative the winding surface such that the partition isolates the first set of turns from the second surface section of the winding surface and isolates the second set of turns and the first surface section of the winding surface; and wherein the passage is axially aligned with the core air gap.

10. The inductive electronic component of claim 9, wherein the bobbin defines oppositely disposed first and second end walls, each end wall defining a shoulder with a shoulder surface above the winding surface.

11. The inductive electronic component of claim 10, further comprising:

the winding having a height relative the winding surface that is less than or equal to a height of each of the shoulder surfaces; and an insulating layer positioned around the winding at a height relative the winding surface equal to or greater than the height of each of the shoulder surfaces.

12. The inductive electronic component of claim 11, further comprising a second winding wound around the insulating layer.

13. The inductive electronic component of claim 10, further comprising the shoulder of the first end wall defines an entry slot; and the winding having a starting portion that is inserted through the entry slot.

14. The inductive electronic component of claim 13, wherein the starting portion is substantially perpendicular to at least one set of turns of the winding.

15. The inductive electronic component of claim 13, further comprising:

an outer portion of the first end wall; and a guiding slot on the outer portion of the first end wall to guide the outer winding from the outer portion to the entry slot.

16. The inductive electronic component of claim 15, further comprising a guiding pin that extends from an exterior surface of the outer portion and being positioned to indicate a position of the guiding slot.

17. The inductive electronic component of claim 15, wherein the outer portion defines a plurality of pins to connect wires to the winding.

18. The inductive electronic component of claim 9, the partition further comprises a first partition wall adjacent to the first surface section and a second partition wall adjacent to the second surface section wherein the passage is defined between the partition walls.

19. A bobbin for an electronic component, the electronic component including a transformer core forming a core air gap, the bobbin comprising:

a bobbin body having a winding surface;

a partition transversely extending from the winding surface, the partition dividing the bobbin body into a first winding section and a second winding section, the partition including a first partition wall and a second partition wall separated by a passage between the first and second partition walls, wherein the passage is axially aligned with the core air gap.

20. The bobbin of claim 19, further comprising:

a first end wall disposed on the bobbin body; and a shoulder extending axially from the first end wall generally toward the partition, the shoulder includes a shoulder height extending from the winding surface, wherein the partition includes a partition height extending from the winding surface, the shoulder height being no less than the partition height.

* * * * *